United States Patent [19]

Kaduki et al.

[11] 4,073,611

[45] Feb. 14, 1978

[54] CONTROL SYSTEM FOR GAS BURNING APPARATUS

[75] Inventors: Charles L. Kaduki, Auburn; Richard D. Stoneking, Corunna, both of Ind.

[73] Assignee: Essex Group, Inc., Fort Wayne, Ind.

[21] Appl. No.: 732,615

[22] Filed: Oct. 15, 1976

[51] Int. Cl.[2] ..... F23Q 9/14

[52] U.S. Cl. ..... 431/45; 431/54

[58] Field of Search ..... 431/43, 45, 46, 53, 431/54

[56] References Cited

U.S. PATENT DOCUMENTS

| | | | |
|---|---|---|---|
| 2,448,475 | 8/1948 | Strobel | 431/46 |
| 3,062,276 | 11/1962 | Miller | 431/46 |

*Primary Examiner*—Carroll B. Dority, Jr.
*Attorney, Agent, or Firm*—Robert D. Sommer; Lawrence E. Freiburger

[57] ABSTRACT

A control system for a gas burning apparatus having a pilot burner which is initially ignited by electric ignition means upon a need for operation of the apparatus and which in turn ignites a main burner after a flame is established at the pilot burner, the gas flow to the pilot burner being through a first valve and the gas flow to the main burner being through a second valve receiving its gas supply from the first valve. The control system includes flame relay switching means responsive to the presence and absence of flame at the pilot burner and actuated when the control system is initially energized to open the first valve while preventing opening of the second valve and to energize a holding circuit which maintains the first valve open and enables opening of the second valve when the flame relay switching means is subsequently deactuated in response to the establishment of a pilot flame. The control system further includes time delay switching means responsive to the continued absence of pilot flame for a predetermined time interval during a start-up operation or following a loss of pilot flame after start-up to cause closing of the valves. The control system incorporates a fail-safe circuit arrangement so that the gas burning apparatus will be placed in a fail-safe condition in response to the failure of any key component of the control system or the failure of the electric power supply.

5 Claims, 2 Drawing Figures

CONTROL SYSTEM FOR GAS BURNING APPARATUS

BACKGROUND OF THE INVENTION

This invention relates to control systems for gas burning apparatus and more particularly to an improved fuel control system for the reliable and safe operation of gas burning apparatus of the type in which the supply of gas to a pilot burner is through a first valve and the supply of gas to a main burner is through the first valve and a second valve downstream of the first valve.

In some types of gas burning apparatus, it has been a common practice to employ a continuously burning pilot flame for igniting the main burner. To obviate the need for such a gas-wasting operation of a pilot burner, various automatic fuel control systems have been proposed for directly igniting the main burner of gas burning apparatus whenever operation of the apparatus is required. Such a control system is described in the Newport et al U.S. Pat. No. 3,758,260 issued Sept. 11, 1973. The Matthews U.S. Pat. No. 3,918,881 issued Nov. 11, 1975 discloses a control system for a gas burning apparatus having a pilot valve and a main valve serially connected in the gas supply of a main burner which control system establishes a pilot flame each time operation of the gas burning apparatus is required and subsequently supplies gas to the main burner to be ignited by the pilot flame. This control system includes switching means responsive to the pilot flame which are operative in the absence of a pilot flame to cause opening of only the pilot valve and energization of ignition means for the pilot burner. Upon ignition of the pilot burner, the relay switching means are operative to establish a limited-current holding circuit maintaining the pilot valve open and to simultaneously cause opening of the main valve. A warp switch responsive to full-current energization of the pilot valve is effective to shut down the control system if ignition of the pilot burner does not occur within a predetermined time interval during a start-up operation. Although this control system has certain fail-safe characteristics, any pilot flame simulating failure of the control system such as a failure of the silicon controlled rectifier in a shorted condition could cause an undesirable supply of gas to the main burner with no pilot flame to ignite the gas.

SUMMARY OF THE INVENTION

Therefore, it is the principal object of the present invention to provide a new and improved fuel control system for gas burning apparatus incorporating a simple and reliable circuit arrangement which will place the gas burning apparatus in a fail-safe condition in response to the failure of any key component of the control system.

The present invention comprises a fuel control system for a gas burning apparatus which has a main burner, a pilot burner for igniting the main burner, gas flow control means for the burners, electrically energized ignition means for igniting the pilot burner, flame sensing means responsive to the presence or absence of flame at the pilot burner, and voltage supply means including a controller that is closed to provide an operating voltage upon a need for operation of the gas burning apparatus. The gas flow control means comprise an electrically operated safety valve for controlling gas flow to the pilot burner and an electrically operated main valve receiving its gas supply through the safety valve for controlling gas flow to the main burner. The flame sensing means comprises flame indication switching circuitry operable by a flame sensor at the pilot burner to have a conductive condition in the absence of flame at the pilot burner and a non-conductive condition in the presence of flame at the pilot burner.

In accordance with the invention, the fuel control system includes a normally closed time delay switch having an electrical actuator for opening the time delay switch when energized for a predetermined time interval, an electrically actuated flame relay having a normally closed switch and a normally open switch, and an electrically actuated holding relay having a normally open switch. The time delay switch actuator, the flame relay actuating coil and the flame indicating switching circuitry are connected in series to the voltage supply means. The safety valve operator is connected to the voltage supply means in series with the time delay switch and the normally open flame relay switch connects the main valve operator in parallel with the safety valve operator. Holding circuit means connect the holding relay switch in parallel with the normally open flame relay switch and connect the holding relay actuating coil in parallel with the safety valve operator. When the controller closes upon a need for operation of the gas burning apparatus, the flame relay is actuated to cause the safety valve to open while preventing opening of the main valve and to energize the holding relay. The holding circuit established by energization of the holding relay maintains the safety valve open and enables opening of the main valve when the flame relay is subsequently deactuated in response to the establishment of a pilot flame when gas flowing from the pilot burner is ignited by the ignition means. In the event that the pilot burner is not ignited within a predetermined time interval, the continued energization of the time delay switch actuating means causes opening of the time delay switch to deenergize the safety valve operator.

The invention will be more readily understood from the following detailed description of preferred embodiments of the invention, taken in conjunction with the accompanying drawing wherein:

DESCRIPTION OF PREFERRED EMBODIMENTS

Figure 1:
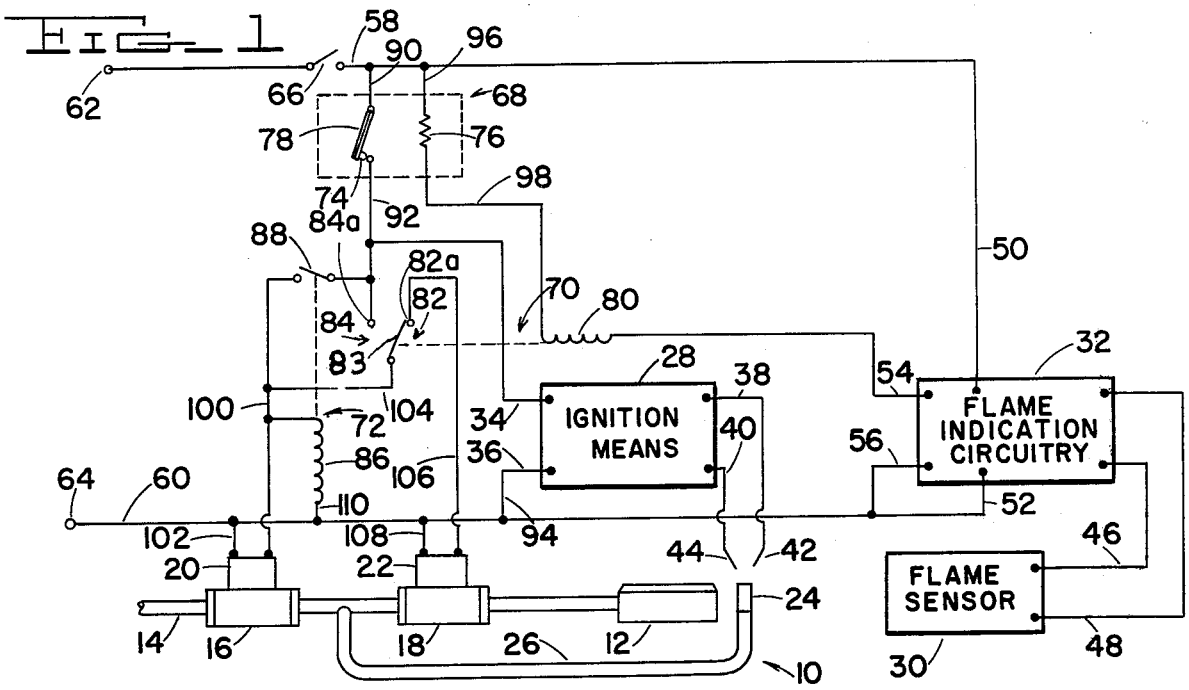
FIG. 1 is a schematic diagram of a first embodiment of a fuel control system according to the present invention.

Referring now to the drawings, attention is directed first to FIG. 1 schematically illustrating the improved fuel control system of the present invention in connection with a portion of a conventional gas burning apparatus indicated generally at 10. The gas burning apparatus 10 has a main burner 12 which is supplied with gas from a suitable source (not shown) by a supply conduit 14. Gas flow control means comprising a normally closed, electrically controlled safety valve 16 and a normally closed, electrically controlled main valve 18 are serially connected in the conduit 14 to control the flow of gas to the main burner 12. The valves 16 and 18 have respective electrical operators 20 and 22 such as solenoid windings which are each energized to open its respective valve and deenergized to close its respective valve. A pilot burner 24 disposed adjacent the main burner 12 is supplied with gas from the outlet of the safety valve 16 through a supply pipe 26 connected to the conduit 14 at a location intermediate the safety valve 16 and the main valve 18.

The gas burning apparatus 10 also includes an ignition means 28, a flame sensor 30, and a flame indication switching circuitry 32 all schematically illustrated by blocks. The ignition means 28 has electrical power input leads 34 and 36 and may be of the electrically heated glow ignitor type or, as shown in FIG. 1, may be of the spark generating type having output leads 38 and 40 connected respectively to spark electrodes 42 and 44 which are positioned adjacent the pilot burner 24 for igniting gas flowing from the pilot burner 24. The flame sensor 30 has electrical output leads 46 and 48 connected to the flame indication switching circuitry 32 and is positioned adjacent the pilot burner 24 to be responsive to the presence or absence of flame at the pilot burner. The flame indication switching circuitry 32 is provided with electrical energy by the power input leads 50 and 52 and has a current control circuit including leads 54 and 56 which has a conductive condition in the absence of flame at the pilot burner 24 and a non-conductive condition in the presence of flame at the pilot burner 24. The flame sensor 30 and the flame indication switching circuitry 32 may comprise the flame rod and the solid state circuitry respectively indicated by like reference numerals in FIG. 2 or may take any one of a number of flame sensing arrangements which are well-known in the art.

The ignition means 28 and the various components comprising the fuel control system of the present invention are supplied with alternating current voltage by a pair of conductors 58 and 60 connected to a pair of input terminals 62 and 64 which in turn are adapted for connection to a suitable electric power source (not shown). The input terminal 64 is connected directly to the conductor 60 and the input terminal 62 is connected to the conductor 58 through a normally open controller 66 such as a thermostatic switch which is closed upon a need for operation of the gas burning apparatus.

The supply of gas to the main burner 12 and the pilot burner 24 is controlled by the improved fuel control system of the present invention in a safe and efficient manner. This control system includes a time delay switch 68, a flame relay 70 and a holding relay 72. Although the time delay switch 68 may take various forms, it is shown in the drawing as having normally closed contacts 74 controlled by an electrical actuator comprising an electrical resistance heater 76 disposed adjacent a bimetal blade 78 and operative when energized for a predetermined time interval to heat the bimetal blade 78 sufficiently to open the contacts 74. The flame relay 70 includes an actuator coil 80 which when energized opens a normally closed relay switch 82 and closes a normally open relay switch 84. To ensure the opening of one of the relay switches 82 and 84 prior to the closing of the other, these relay switches are incorporated in a double-throw contact arrangement in which a movable contact 83 may be transferred to engage either of two stationary contacts 82*a* and 84*a*. The holding relay 72 includes an actuator coil 86 which when energized closes a normally open relay switch 88.

The ignition means 28 is connected across the voltage supply conductors 58 and 60 through conductor 90, contacts 74 of the time delay switch 68, conductor 92, input leads 34 and 36, and conductor 94. The input leads 50 and 52 of the flame indication switching circuitry 32 are connected directly to the supply conductors 58 and 60. A flame condition circuit comprising the conductors 96 and 98 and the leads 54 and 56 of the flame indication switching circuitry 32 connects the time delay switch heater 76 and the flame relay coil 80 in series across the supply conductors 58 and 60 when the flame indication switching circuitry 32 is in a conductive condition. A normally open valve operator circuit comprising the conductors 90, 92, 100 and 102 connects the valve operator 20 across the supply conductors 58 and 60 in series with the time delay switch contacts 74 and the flame relay switch 84. The valve operator circuit further includes a subcircuit comprising the conductors 100, 104, 106 and 108 connecting the valve operator 22 in parallel with the valve operator 20 through the flame relay switch 82. A holding circuit comprising the holding relay switch 88 connected in parallel with the flame relay switch 84 and the holding relay coil 86 connected in parallel with the valve operator 20 extends from the conductor 92 through the holding relay switch 88 (when closed), the conductor 100, the holding relay coil 86, and the conductor 110 to the supply conductor 60.

The fuel control system of FIG. 1 is shown in a standby condition with the controller 66 open and all components of the control system therefore deenergized. Upon a need for operation of the gas burning apparatus 10, the controller 66 is closed to apply an operating voltage to the supply conductors 58 and 60. At this time, the ignition means 28 is energized through the time delay switch contacts 74 to provide a high voltage spark across the electrodes 42 and 44. Simultaneously, the flame indication switching circuitry 32 is energized and provides a conductive path between its current control circuit leads 54 and 56 since there is no flame at the pilot burner 24. As a result, the flame relay coil 80 is energized to simultaneously close its switch 84 and open its switch 82. The closing of flame relay switch 84 completes an energization circuit for the valve operator 20 through the time delay switch contacts 74, causing the safety valve 16 to open and supply gas to the pilot burner 24. The closing of the flame relay switch 84 also completes an energization circuit for the holding relay coil 86, causing the holding relay 72 to close its switch 88. The holding relay switch 88 completes a holding circuit bypassing the flame relay switch 84 and maintaining the safety valve operator 20 energized independently of the flame relay switch 84. The main valve 18, however, remains closed since the opening of the flame relay switch 82 interrupts the subcircuit connecting the main valve operator 22 in parallel with the safety valve operator 20.

Under normal operating conditions, the gas flowing from the pilot burner 24 will be ignited in a very short period of time after opening of the safety valve 16. When the presence of flame at the pilot burner 24 is sensed by the flame sensor 30, the current control circuit between the leads 54 and 56 of the flame indicating switching circuitry 32 is rendered non-conductive thereby deenergizing the time delay switch heater 76 and the flame relay coil 80. Deenergization of the flame relay coil 80 causes the flame relay switch 84 to open and the flame relay switch 82 to close. Upon opening of the flame relay switch 84, the valve operator 20 remains energized through the holding relay switch 88 and the concurrent closing of the flame relay switch 82 completes the subcircuit connecting the main valve operator 22 in parallel with the safety valve operator 20. The main valve 18 is opened upon energization of its operator 22 to supply gas to the main burner 12 where it is ignited by the pilot burner 24.

If, during startup of the gas burning apparatus 10 following closing of the controller 66, the pilot burner 24 fails to ignite within a predetermined time interval, the continued energization of the time delay switch heater 76 will result in opening of the time delay switch contacts 74, thereby deenergizing the initial energizing and holding circuits for the valve operator 20 to interrupt the flow of gas to the pilot burner 24. The heater 76 of the time delay switch 68 will remain energized under these conditions so long as the controller 66 remains closed.

Should the flame at the pilot burner 24 be extinguished during normal operation of the gas burning apparatus 10, the current control circuit between the leads 54 and 56 of the flame indication switching circuitry 32 becomes conductive again thereby energizing the flame relay coil 80 and the time delay switch heater 76. Energization of the flame relay coil 80 causes the flame relay switch 82 to open interrupting the subcircuit of the main valve operator 22 to close the main valve 18. The main valve 18 will remain closed until a flame is established again at the pilot burner 24.

If a failure of the electric power source occurs during normal operation of the gas burning apparatus 10, the safety valve operator 20 and the main valve operator 22 as well as the flame relay coil 80 and the holding relay coil 86 are deenergized. Deenergization of the valve operators 20 and 22 causes closing of the respective valves 16 and 18 within a short time both burners 12 and 24 become extinguished. Upon restoration of electric power to the input terminals 62 and 64, the main valve operator 22 will not be energized until a flame is established again at the pilot burner 24. The quantity of gas confined within the supply pipe 26 following closing of the valves 16 and 18 may be sufficient to maintain the pilot burner 24 ignited during an electric power interruption of very short duration. Upon restoration of electric power to the input terminals 62 and 64 following such a brief power interruption during normal operation of the gas burning apparatus 10, the presence of flame at the pilot burner 24 is sensed by the flame sensor 30 to render the flame indication switching circuitry 32 non-conductive. Hence, the flame relay coil 80 will remain deenergized to prevent energization of the safety valve operator until the flame at the pilot burner 24 is extinguished. As pointed out below, such operation of the control system to prevent start-up of the gas burning apparatus 10 unless the flame indication switching circuitry 32 is initially operable by the flame sensor 30 to have a condition indicative of the absence of flame at the pilot burner 24 provides an important safety function.

The fuel control system of FIG. 1 provides for a fail-safe operation of the gas burning apparatus 10 by a self-checking operation of the control system upon each closing of the controller 66. Two self-checking safety functions are obtained by connection of the flame relay coil 80 in series with the time delay switch heater 76 and the current control circuit leads 54 and 56 of the flame indication switching circuitry 32. Firstly, an open circuit condition of the time delay switch heater 76 prevents energization of the flame relay coil 80 whereupon neither the safety valve 16 nor the main valve 18 can be opened. This first safety function is essential since no gas should be supplied to the gas burning apparatus 10 when the time delay switch 68 is inoperative to deenergize the valve operator circuit in the event ignition of the pilot burner 24 does not occur. Secondly, any pilot flame simulating failure of the flame indication switching circuitry 32 or of the flame sensor 30 prevents energization of the flame relay coil 80 whereupon neither the safety valve 16 nor the main valve can be opened. This first safety function is essential since no gas should be supplied to the gas burning apparatus 10 when the time delay switch 68 is inoperative to deenergize the valve operator circuit in the event ignition of the pilot burner 24 does not occur. Secondly, any pilot flame simulating failure of the flame indication switching circuitry 32 or of the flame sensor 30 prevents energization of the flame relay coil 80 whereupon neither the safety valve 16 nor the main valve 18 can be opened. This second safety function is also essential to ensure that the flame indication switching circuitry 32 will be effective to cause closing of the valves 16 and 18 if the burners 12 and 24 are extinguished during operation of the gas burning apparatus 10. In this connection, it is to be noted that the main valve 18 cannot be opened to supply gas to the main burner 12 unless the flame indication switching circuitry is initially in a conductive condition upon closing of the controller 66 and is then rendered non-conductive in response to ignition of the pilot burner 24.

Additional self-checking safety functions are provided by the relay switching arrangement of the normally open valve operator circuit and the holding circuit. In this relay switching arrangement, the flame relay 70 controls both the initial energization of the safety valve operator 20 and the subsequent energization of the main valve operator 22 following ignition of the pilot burner 24. Thus, a first check on the operation of the flame relay 70 occurs when its coil 80 is initially energized upon closing of the controller 66. An open circuit failure of the flame relay coil 80 or a welded closed failure of the flame relay switch 82 will prevent the closing of the flame relay switch 84. Hence, no electrical power is applied to the safety valve operator 20 and no gas is supplied to either the pilot burner 24 or the main burner 12. A second check on the operation of the flame relay 70 occurs when its coil 80 is deenergized by the flame indication switching circuitry 32 in response to ignition of the pilot burner 24. If the relay switch 84 fails to open due to sticking or welding of its contacts, the relay switch 82 will not return to its normally closed position. Hence, no electrical power is applied to the main valve operator 22 and no gas is supplied to the main burner 12. It will also be apparent that an open circuit failure of the coil 86 of the holding relay 72 will prevent energization of the main valve operator 22.

The present invention provides an additional fail-safe feature of importance if a welded closed failure of the flame relay switch 82 occurs during normal operation of the gas burning apparatus 10 and the pilot burner 24 is extinguished and fails to reignite within a predetermined time interval. Under these conditions, the energization of the time delay switch heater 76 will result in the opening of the time delay switch contacts 74, thereby deenergizing the valve operators 20 and 22 to interrupt the flow of gas to the burners.

Figure 2:
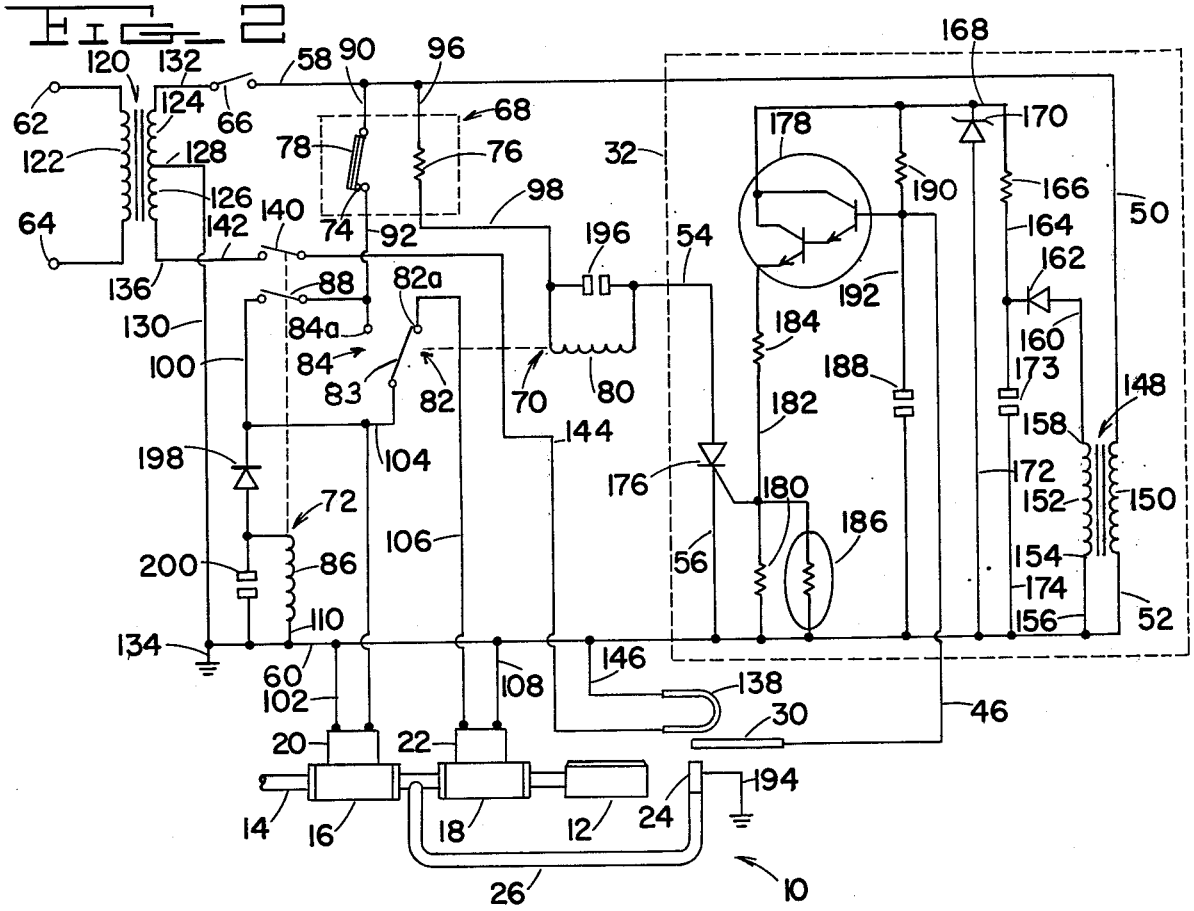
FIG. 2 is a schematic diagram of a modification of the fuel control system of FIG. 1.

Referring now to FIG. 2 of the drawing, there is shown a second embodiment of the improved fuel control system of the present invention which is similar in design and operation to the embodiment shown in FIG. 1. Components that are the same as or similar to those in the embodiment shown in FIG. 1 are identified with the same reference numerals. The fuel control system shown in FIG. 2 includes a step-down transformer 120 having a primary winding 122 and two secondary windings 124 and 126. The primary winding 122 is connected to the terminals 62 and 64 for energization by a suitable power source. The secondary windings 124 and 126 have a common terminal 128 which is connected to the conductor 60 by the conductor 130 and the other terminal 132 of the secondary winding 124 is connected to the conductor 58 through the controller 66. The turns ratio of the primary winding 122 to the secondary winding 124 is selected to provide a voltage across the terminals 128 and 132 of approximately 24 volts. The conductor 60 is grounded at 134 and provides a ground for the entire fuel control system.

The secondary winding 126 has a turns ratio with respect to the primary winding 122 providing a voltage across the terminals 128 and 136 of approximately 4 volts for energization of a resistance igniter 138 of the glow-wire or silicon carbide type. The igniter 138 is heated to a gas ignition temperature upon a predetermined current flow therethrough and is positioned adjacent the pilot burner 24 for igniting gas flowing from the pilot burner 24. The holding relay 72 includes a second normally open relay switch 140 which is employed to complete an ignition energization circuit for the igniter 138 when the controller 66 is closed upon a need for operation of the gas burner apparatus 10. The ignition energization circuit is connected across the terminals 136 and 128 of the transformer secondary winding 126 and comprises a conductor 142, the holding relay switch 140, a conductor 144, the igniter 138, and the conductors 146, 60 and 130.

The flame indication switching circuitry 32 includes a step-up transformer 148 having a primary winding 150 connected by the leads 50 and 52 to the voltage supply conductors 58 and 60 and a secondary winding 152 providing an output voltage of approximately 120 volts. A terminal 154 of the secondary winding 152 is connected to the grounded conductor 60 by a conductor 156 and the other terminal 158 is connected by a conductor 160, a rectifier 162, a conductor 164, a resistor 166, and a conductor 168 to the cathode of a Zener diode 170 which has its anode connected by a conductor 172 to the conductor 60 to provide a regulated DC voltage at the conductors 168 and 60. A smoothing capacitor 173 is connected at one side by the conductor 164 to the output of the rectifier 162 and at the other side by a conductor 174 to the conductor 60.

The flame indication switching circuitry 32 further includes an SCR 176 or like controlled switching means having its anode connected to the lead 54 and its cathode connected to the lead 56. Triggering of the SCR 176 is controlled by a Darlington amplifier type semiconductor device 178 connected in a gating circuit extending across the conductors 60 and 168 and comprising a resistor 180, a conductor 182, a resistor 184, and the emitter-collector path of the Darlington amplifier device 178. The resistor 180 is connected at one end to the gate of the SCR 176 by the conductor 182 and is connected at the other end to the cathode of the SCR 176 by the conductors 60 and 56. A thermistor 186 is connected in parallel with the resistor 180 to compensate for variations in the gating voltage of the SCR 176 due to ambient temperature changes. A biasing network for the Darlington amplifier device 178 comprises a capacitor 188 and a resistor 190 connected in series by a conductor 192 across the conductors 60 and 168, the conductor 192 connecting the base of the Darlington amplifier device 178 to the junction of the capacitor 188 and the resistor 190. The flame sensing rod or electrode 30 is also connected to the junction of the capacitor 188 and the resistor 190 by means of the lead 46 and the conductor 192. The flame sensing rod 30 is positioned adjacent the pilot burner 24 such that the flame produced by the pilot burner bridges the pilot burner 24 and the flame sensing rod 30. As the pilot burner 24 is grounded at 194, the presence of flame at the pilot burner 24 completes a conductive path shunting the capacitor 188 which extends from the conductor 192 through the lead 46, the flame sensing rod 30, the pilot burner 24, and the grounds 194 and 134 to the conductor 60. The impedance of the pilot burner flame is of the same order of magnitude as the resistance of the resistor 190 and therefor the voltage across the capacitor 188 is substantially reduced when flame is present at the pilot burner 24. In the absence of flame at the pilot burner 24, the capacitor 188 is charged to a voltage biasing the Darlington amplifier device 178 into conduction. The resulting current flow through the resistor 180 develops a gating voltage triggering the SCR 176 into conduction. However, whenever the pilot burner 24 and the flame sensing rod 30 are bridged by the pilot flame, the current flow through the pilot flame results in a voltage drop across the resistor 190 which substantially reduces the biasing voltage applied to the Darlington amplifier device 178. The resulting reduction in the emitter current of the Darlington amplifier device 178 reduces the voltage drop across the resistor 180 to a value insufficient to trigger the SCR 176 into conduction.

Since a half wave rectified current flows through the SCR 176 when in its conductive condition, the flame relay 70 is a DC relay having a capacitor 196 connected across the relay coil 80 for proper operation of the relay with half wave electrical energy. The holding relay 72 may also be a DC relay in which case a rectifier or diode 198 is connected in series with the relay coil 86 and a capacitor 200 is connected in parallel with the relay coil 86.

The fuel control system of FIG. 2 operates in a manner generally similar to that described above for the fuel control system of FIG. 1. Upon closing of the controller 66, the primary winding 150 of the transformer 148 is energized from the supply conductors 58 and 60. The rectified output voltage of the secondary winding 152 supplied to the conductors 60 and 168 causes the capacitor 188 to charge through the resistor 190 to a voltage biasing the Darlington amplifier device 178 into conduction. The current flow through the emitter-collector path of the Darlington amplifier device 178 produces a voltage drop across the resistor 180 which triggers the SCR 176 into conduction, thereby completing the flame condition circuit comprising the flame relay coil 80 and the time delay switch heater 76. Upon being energized, the flame relay 70 closes its switch 84 and opens its switch 82. The closing of the flame relay switch 84 energizes the safety valve operator 20, causing the safety valve 16 to open and supply gas to the pilot burner 24. The closing of the flame relay switch 84 also energizes the holding relay coil 86, causing the holding relay 72 to close its switches 88 and 140. The closing of the holding relay switch 88 completes a holding circuit bypassing the flame relay switch 84 and the closing of the holding relay switch 140 completes an ignition energization circuit to energize the igniter 138. The main valve 18, however, remains closed since the opening of the flame relay switch 82 interrupts the subcircuit connecting the main valve operator 22 in parallel with the safety valve operator 20.

Under normal operating conditions, the igniter 138 will quickly attain a gas ignition temperature and ignite the gas flowing from the pilot burner 24 in a short period of time after opening of the safety valve 16. When the pilot burner 24 and the flame sensing rod 30 are bridged by the resulting pilot flame, the current flow through the pilot flame substantially reduces the biasing voltage applied to the Darlington amplifier device 178, thereby causing a reduction of the current flow through the resistor 180 to a valve where the voltage drop across the resistor 180 is insufficient to trigger the SCR 176 into conduction. The flame relay coil 80 is deenergized upon the SCR 176 being rendered non-conductive to open the flame relay switch 84 and close the flame relay switch 82. Upon opening of the flame relay switch 84, the valve operator 20 remains energized through the holding relay switch 88 and the concurrent closing of the flame relay switch 82 completes the subcircuit connecting the main valve operator 22 in parallel with the safety valve operator 20. The main valve 18 is opened upon energization of its operator 22 to supply gas to the main burner 12 where it is ignited by the pilot burner 24.

It will be apparent that the fuel control system of FIG. 2 will function under abnormal operating conditions in the same manner described above in connection with the fuel control system of FIG. 1. It will also be evident that the fuel control system of FIG. 2 incorporates the same self-checking functions provided by the fuel control system of FIG. 1. It is to be particularly noted that the present invention provides for a fail-safe operation in event of the failure of either the SCR 176 in a shorted condition or the flame sensing rod 30 in a low resistance or shorted connection to the pilot burner 24.

While the invention has been described with reference to certain specific embodiments, it is to be understood that this description is made by way of example and not as a limitation to the scope of the invention.

What is claimed is:

1. In a gas burning apparatus including a main burner, a pilot burner, a gas supply for said burners, a first electrically controlled valve in said gas supply and operable to supply gas to said pilot burner, and a second electrically controlled valve receiving its gas supply through said first valve and operable to supply gas to said main burner, each of said valves having an electrical operator which is energized to open its respective valve and is deenergized to close its respective valve; a control system for controlling the operation of said valves and effecting ignition of gas supplied to said burners comprising:

electrically energized ignition means for igniting gas flowing from said pilot burner;

an ignition energization circuit for said ignition means;

a normally open valve energization circuit for said first valve operator including a subcircuit connecting said second valve operator in parallel with said first valve operator;

a flame sensor responsive to the presence or absence of flame at said pilot burner;

a flame condition circuit including flame indicating switching circuitry operable by said flame sensor to have a conductive condition in the absence of flame at said pilot burner and a non-conductive condition in the pesence of flame at said pilot burner;

flame relay means having a normally open switch in said valve energization circuit in series with said first valve operator and a normally closed switch in said subcircuit in series with said second valve operator;

said flame relay means further including electrical actuating means connected in said flame condition circuit in series with said flame indication switching circuitry for operating said normally open and normally closed switches whereby said flame relay means is effective to complete the valve energization circuit and interrupt said subcircuit of said second valve operator in the absence of flame at said pilot burner;

holding relay means in said valve energization circuit and operable in response to energization of said flame relay actuating means for maintaining said first valve operator energized independently of said flame relay means and permitting energization of said second valve operator through said normally closed switch of said flame relay means when flame is established at said pilot burner; and a normally closed time delay switch connected in series with said valve energization circuit and having an electrical actuator connected in said flame condition circuit in series with said flame indication switching circuitry and operable to open said time delay switch after said flame indication switching circuitry remains in a conductive state for a predetermined time interval in excess of a prescribed ignition period for said pilot burner.

2. A fuel control system for a gas burning apparatus or the like having a main burner and a pilot burner;

gas flow control means including a safety valve and a main valve serially connected in the order named to said main burner for controlling gas flow to said main burner, each of said safety and main valves having an electrical operator which is energized to open its respective valve and is deenergized to close its respective valve;

said gas flow control means further including an outlet between said safety and main valves connected to said pilot burner for supplying gas to said pilot burner when said safety valve is open;

electrically energized igniting means for igniting gas flowing from said pilot burner;

flame sensing means having a flame sensor responsive to the presence or absence of flame at said pilot burner and including flame indication switching circuitry operable by said flame sensor to have a conductive condition in the absence of flame at said pilot burner and a non-conductive condition in the presense of flame at said pilot burner;

fuel control voltage supply means including a controller for connecting said fuel control system in an electric power source upon a need for operation of said gas burning apparatus; and ignition voltage supply means controlled by said controller for connecting said igniting means to said electrical power source upon a need for operation of said gas burning apparatus;

said fuel control system comprising:

a normally closed time delay switch having electrical actuator means operable when energized for a predetermined time interval to open said time delay switch;

a flame relay having a normally closed switch and a normally open switch and including electrical actuating means operative when energized to open said normally closed switch and close said normally open switch;

flame condition circuit means connecting said time delay switch actuator means, said flame relay actuating means, and said flame indication switching circuitry in series to said fuel control voltage supply means;

valve operator circuit means connecting said normally closed flame relay switch and said main valve operator in series connection across said safety valve operator;

initial energization circuit means for said safety valve operator connecting said time delay switch, said normally open flame relay switch and said safety valve operator in series to said fuel control voltage supply means; and holding circuit means for said valve operators having a normally open holding switch connected in parallel with said normally open flame relay switch and including means operable in response to closing of said normally open flame relay switch to close said holding switch and to subsequently maintain said holding switch closed independently of said normally open flame relay switch.

3. The fuel control system of claim 2 wherein said flame indication switching circuitry includes solid state switching means in series connection with said time delay switch actuator means and said flame relay actuating means and further includes gating means normally triggering said solid state switching means into conduction; and wherein said flame sensor is operative in response to the presence of flame at said pilot burner to render said gating means ineffective to trigger said solid state switching means into conduction.

4. The fuel control system of claim 2 wherein said holding circuit means include a holding relay and said means for closing said holding switch include relay coil means connected in parallel with said safety valve operator.

5. The fuel control system of claim 4 wherein said holding relay includes a second normally open switch which is closed upon energization of said relay coil means; and wherein said ignition voltage supply means include circuit connections connecting said second normally open switch in series with said igniting means.

* * * * *